US009945621B2

(12) United States Patent
Bayram et al.

(10) Patent No.: US 9,945,621 B2
(45) Date of Patent: Apr. 17, 2018

(54) COOLING DEVICE HAVING AN ELASTIC FIXING MEMBER AND A VALVE HOLDER GROUP

(71) Applicant: BSH HAUSGERAETE GMBH, Munich (DE)

(72) Inventors: Sueleyman Bayram, Tekirdag (TR); Murat Darka, Tekirdag (TR); Dogan Kilinc, Istanbul (TR); Istem Oezkan, Istanbul (TR)

(73) Assignee: BSH Hausgeraete GmbH, Munich (DE)

( * ) Notice: Subject to any disclaimer, the term of this patent is extended or adjusted under 35 U.S.C. 154(b) by 154 days.

(21) Appl. No.: 14/439,754

(22) PCT Filed: Oct. 29, 2013

(86) PCT No.: PCT/EP2013/072610
§ 371 (c)(1),
(2) Date: Apr. 30, 2015

(87) PCT Pub. No.: WO2014/067946
PCT Pub. Date: May 8, 2014

(65) Prior Publication Data

US 2015/0292821 A1 Oct. 15, 2015

(30) Foreign Application Priority Data

Oct. 31, 2012 (TR) ..... a 2012 12498

(51) Int. Cl.
*F28F 9/26* (2006.01)
*F25D 23/00* (2006.01)

(52) U.S. Cl.
CPC ..... *F28F 9/26* (2013.01); *F25D 23/006* (2013.01); *F25B 2500/13* (2013.01)

(58) Field of Classification Search
CPC ..... F16L 3/00; F16L 3/08; F16L 3/223; F16L 3/2235; F16L 3/227; Y10T 403/59; Y10T 403/60; Y10T 403/606
See application file for complete search history.

(56) References Cited

U.S. PATENT DOCUMENTS

2008/0196446 A1* 8/2008 Nakamura ..... F25B 5/04 62/498
2012/0214328 A1* 8/2012 Downing ..... F16L 3/00 439/345

FOREIGN PATENT DOCUMENTS

DE 102005059490 A1 6/2007
JP S55162083 U 11/1980
JP H06207773 A 7/1994
JP H10232086 A 9/1998
(Continued)

*Primary Examiner* — Lionel Nouketcha
(74) *Attorney, Agent, or Firm* — Laurence A. Greenberg; Werner H. Stemer; Ralph E. Locher

(57) ABSTRACT

A cooling device has an elastic fixing member for fixing a valve which is cooperating with a compressor and disposed in a compressor room of a heat insulated body. The cooling device includes a bearing bracket for fixing the valve in the compressor room. The uniform elastic fixing member has at least one rear directional fixing extension for insertion into at least one locking hole of the bearing bracket, at least one fixing extension formed opposite the rear directional fixing extension for insertion into at least one hole on the valve, and an insulator section for reclining the valve.

12 Claims, 8 Drawing Sheets

(56) References Cited

FOREIGN PATENT DOCUMENTS

| | | | | |
|---|---|---|---|---|
| JP | 2001099541 | A | | 4/2001 |
| JP | 2012083078 | A | | 4/2012 |
| KR | 20090041683 | A | * | 4/2009 |
| SU | 1686283 | A1 | | 10/1989 |

* cited by examiner

COOLING DEVICE HAVING AN ELASTIC FIXING MEMBER AND A VALVE HOLDER GROUP

TECHNICAL FIELD

The present invention relates to a cooling device having fixing or holding members disposed in the part where a cooling compressor is provided and fixing a solenoid valve, a stop valve and other similar auxiliary valves affecting the operation of the compressor.

RELATED ART

The cooling devices generally comprise various cooler and freezer compartments so as to form a cooler part and/or a freezer part. The cooler part retards the spoiling of foodstuff disposed therein and preserves foodstuff. The freezer part provides freezing of the foodstuff disposed therein by keeping the temperature of inside at zero degrees or lower than zero degrees.

Compressor forms the main part of the cooling system and performs compressing of the gas, exiting the evaporator, up to the condensation pressure. There are other compressor types and designs which can realize this function; however, in domestic type refrigerators, compressors with hermetic piston are utilized. In hermetic compressors, single-phase, double-pole asynchronous induction engines are utilized. In variable-speed compressor applications, speed control is realized by changing frequency. Direct current engines, induction engines and synchronous engines are utilized in compressors where speed control is realized. The compressor cylinder volume is changing between 2 $cm^3$ and 10 $cm^3$ depending on the volume of the cooling device and depending on the refrigerant utilized. The refrigerant is compressed by means of a piston in cylinder volume provided inside the compressor. The pressure of the compressed refrigerant is increasing. In order for the refrigerant to leave the cylinder, it has to overcome the pressure losses in the compression valve. As the compression valve is opened, the refrigerant is pumped at a high pressure and temperature.

A cooling device can have at least two different compartments, namely a cooler part and a freezer part. In general, domestic type cooling devices are in this form. During the operation of the compressor, a solenoid valve permits passage of the fluid gas particularly for the cooling compartment, and afterwards, as the direction of the valve is changed, it covers a path and opens another path, and transfers the fluid gas to the freezer compartment.

The solenoid valve is an electromechanical valve controlling the flow of liquid and gasses. The solenoid valve applies current to the helical wire on the solenoid and provides change of the position of the valve. The operation principle is similar to the operation principle of electrical switches; however, the moving item here is the gas or liquid instead of the electrical current. It is possible to use multi-path solenoid valve, in this manner, instead of interrupting and applying the current, current passes to one of the two different paths.

The stop valve has the same properties as the solenoid valve; however, since one of the directions is closed, the flow is one-directional. The function of the stop valve is as follows; there is compressed gas in the high pressure side of the compressor and when the compressor begins functioning, the stop valve holds a part of this high pressure and provides power saving since it helps the first operation movement of the compressor.

The cooling device has a compressor room dedicated for positioning the compressor. The valves are provided next to the compressor in a fixed manner to a metal sheet in the compressor room. The valve is assembled to a metal sheet or to a plastic embodiment which is a mounting element to be disposed to the compressor room by utilizing screw or similar connection members through the present holes on the valve.

In the part where the solenoid valve is in assembled form, vibrations occur because of the continuous intermittently operation of the solenoid and other valves. As a result of the vibrations, the valves hit the metal sheet and similar fixation places thereof. As a result of the impacts, sound and noise are occurring.

In the present art, valve holder members are disclosed. JP 1012 083078 A discloses a refrigerator in which a valve is fixed to a vibration absorbing member by screws, and the vibration absorbing member, in turn, is screwed to a support for installation in the refrigerator cabinet.

BRIEF DESCRIPTION OF THE INVENTION

The object of the present invention is to fix of a solenoid valve, a stop valve and other similar auxiliary valves affecting the operation of the compressor and positioned in the part of the cooling device where a cooling compressor is provided and to decrease vibrations and noise occurring during the operation of the valves.

All of the abovementioned objects and the objects which are to be deducted from the detailed description below are achieved by a cooling device as defined in claim 1. Thus, the vibrations occurring during operation of the valves fixed by utilizing the elastic fixing member are absorbed and the noise resulting from vibration is minimized. The elastic absorption member can realize a fixation function by means of a fixation part between the valve and the position the valve is assembled thereto, and a vibration absorption function by means of the insulator part.

In another embodiment of the present invention, the insulator section of the elastic fixing member comprises at least one groove corresponding to the form of a lateral wall of the valve. Thus, since the extensions, resulting from the form of the lateral wall of the valve, will be placed to the groove, the elastic fixation member is provided to completely contact a lateral wall of the valve. By means of full contact, the possible vibrations are minimized.

In another embodiment of the present invention, the fixing extension of the fixing section of the elastic fixing member comprises a head part, a conic body part corresponding to the hole of the valve and a recessed part. Thus, the elastic fixation extension is held and extended and passed through the valve hole and it is fixed so as not to be removed from the hole when released. Since they are compatible to each other, the elastic fixation extension can be easily passed through the valve hole.

In another embodiment of the present invention, the reverse directional fixing extension of the fixing section of the elastic fixing member comprises a head part, a protruding part corresponding to the form of the locking hole of the bearing bracket and a recessed part.

Thus, the reverse directional elastic fixing extension is held and extended and passed through the valve hole and it is fixed so as not to remove from the hole when released. Since they are compatible to each other, the elastic fixation extension can be easily passed through the valve hole.

In another embodiment of the present invention, the cooling device comprises a valve holder group having at least one bearing bracket, at least one pipe retainer and at least one elastic fixing member. Thus, by means of the valve holder group, provides the valve or the valves can be assembled to the compressor room in a safe manner and fixed so as to absorb vibrations in terms of working efficiency.

In another embodiment of the present invention, the bearing bracket comprises one each of reclining walls formed on a planar body of the bearing bracket at each of two sides and providing to fix the elastic fixing member from each side. Thus, the elastic fixation member is fixed from sides for preventing the removal or the rotation thereof.

In another embodiment of the present invention, the locking hole of the bearing bracket comprises a wide part in a circular shape and a narrow part continuing form the wide part. Thus, the reverse directional fixing extension of the elastic fixing member is passed through the wide part of the locking hole, and it is pushed towards the narrow part and fixation is realized in the narrow part.

In another embodiment of the present invention, the locking hole of the bearing bracket comprises at least one tab providing to lock the reverse directional fixing extension and formed on the locking hole. Thus, by means of the tabs, it becomes more difficult to remove the reverse directional fixing extension through the locking hole.

In another embodiment of the present invention, the bearing bracket comprises at least one locking protrusion formed on the bearing bracket and providing to mount the bearing bracket to at least one housing of a mounting member. Thus, the bearing bracket is fixed to the mounting member.

In another embodiment of the present invention, the bearing bracket comprises a protrusion providing to fix a pipe of the valve, formed on the bearing bracket; and a housing formed on the protrusion and providing to insert the pipe retainer. Thus, the pipe, extending below the valve, is provided to be fixed inside the safe housing by means of an elastic pipe retainer.

In another embodiment of the present invention, the pipe retainer comprises an opening providing the pipe of the valve to pass through. Thus, during fixation, the pipe can be fixed in a manner passing through the opening.

In another embodiment of the present invention, the pipe retainer comprises at least one channel formed between two protrusions and providing to insert the pipe retainer. Thus, by means of the channel, the pipe retainer can be fixed to and removed from the housing.

THE DETAILED DESCRIPTION OF THE INVENTION

Figure 1:
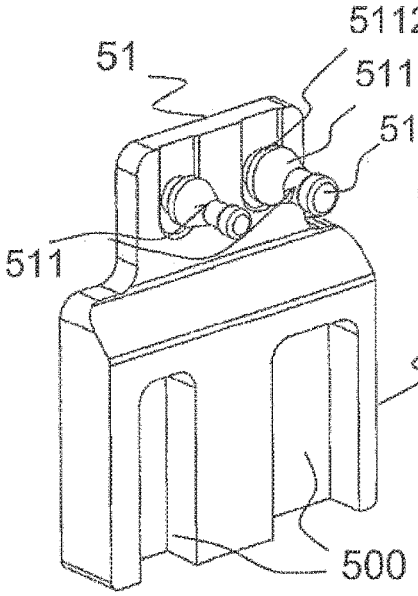
In FIG. 1, a frontal perspective view of a subject matter elastic fixation member is given.

The present invention relates to a cooling device 1 having a valve holder group comprising a bearing bracket 3, a pipe retainer 4 providing fixation of a pipe 22 of the valve 2, an elastic fixing member 5 facilitating decreasing of vibrations and noises occurring during fixing and functioning of a solenoid valve 2, an another valve 2 called the "stop valve" and other similar auxiliary valves 2 positioned in the part where a compressor 14 of a cooling device 1 is provided and affecting the operation of the compressor 14. (See FIG. 8, 13).

Figure 2:
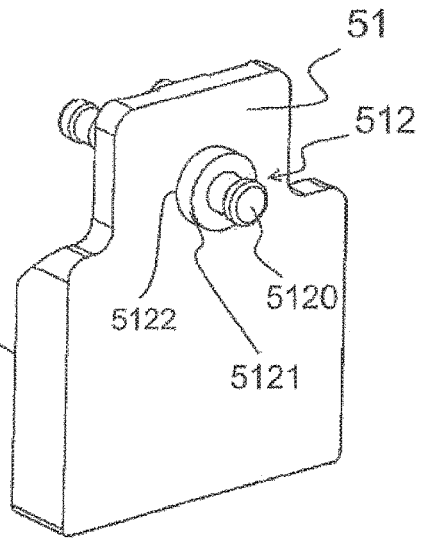
In FIG. 2, a rear perspective view of a subject matter elastic fixation member is given.

In FIG. 1, a frontal perspective view of a subject matter elastic fixing member 5 is given and in FIG. 2, a rear perspective view thereof is given. The elastic fixing member 5 generally comprises two parts. One of these is an insulator section 50 having a dimension so as to meet a lateral wall 23 of the valve 2 and the other one is a fixing section 51. On the insulator section 50, at least one groove 500 is formed wherein the protruded parts, (not illustrated in the figure) of the valve 2 is to be placed.

The fixing section 51 comprises at least one fixing extension or protrusion 511 corresponding so as to meet at least one hole 200 formed on an extension 20 of the valve 2. As can be seen in FIG. 1, there are two fixing protrusions 511. A head part 5110 comprises a conic body part 5111 and a recessed part 5112. While the fixing protrusions 511 are fixed to the related holes 200 of the valve 2, the fixing protrusion 511 is drawn through the head part 5110 and the conic body part 5111 in protrusion form is passed through the hole 200. The recessed part 5112 provided under the conic body part 5111 is disposed to the hole 200. The elastic fixing member 5 is in one piece form and all of the embodiments thereon are made of flexible material. Rubber is utilized as the material. The fixing section 51 moreover comprises at least one reverse directional fixing extension 512 embodied in the reverse direction to the fixing extensions 511, FIG. 2. The reverse directional fixing extension 512 comprises a head part 5120, a circular protruding part 5121 and a recessed part 5122. The form of the protruding part 5121 is compatible to the form of a locking hole 33 of the bearing bracket 3.

Figure 3:
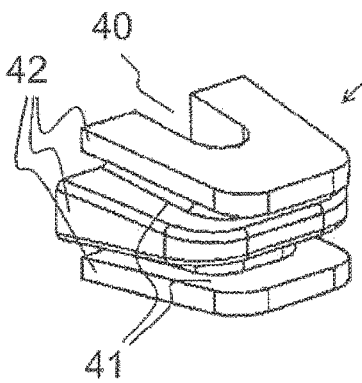
In FIG. 3, a frontal perspective of a subject matter pipe retainer is given.
Figure 4:
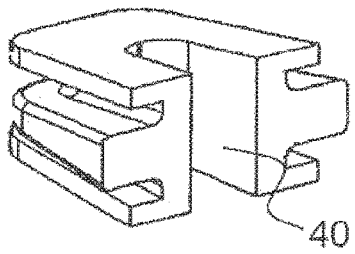
In FIG. 4, a rear perspective of a subject matter pipe retainer is given.

In FIG. 3, the frontal perspective view of the subject matter pipe retainer 4 is given; in FIG. 4, the rear perspective view thereof 4 is given. The shape of the pipe retainer 4 is similar to letter "U", in the middle part thereof, it has an opening 40 similar to letter "U" through which the valve 2 pipe 22 will pass, the lateral parts thereof comprise at least one channel 41 and at least one protrusion 42 formed all-around.

Figure 6:
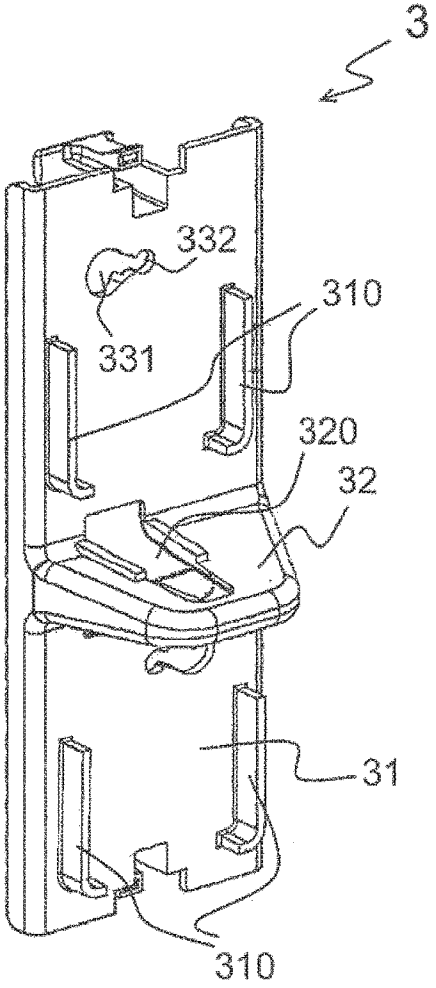
In FIG. 6, a frontal perspective view of a subject matter bearing bracket is given.
Figure 5:
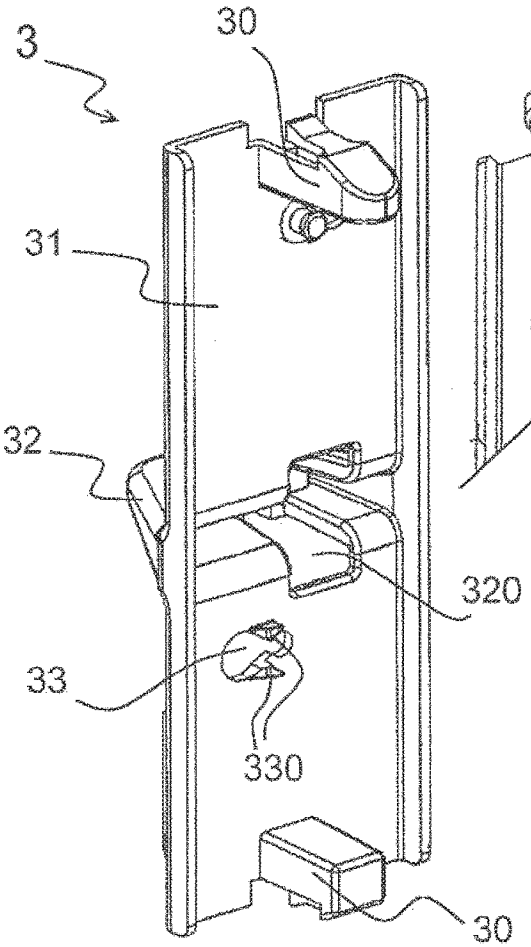
In FIG. 5, a rear perspective view of a subject matter bearing bracket is given.

In FIG. 5, the rear perspective view of a subject matter bearing bracket 3 is given; in FIG. 6, the frontal perspective view thereof 3 is given. The bearing bracket 3 has a long planar body 31 in rectangular form providing bedding for all removable members such that valve 2, elastic fixing member 5 and pipe retainer 4. Moreover, the bearing bracket 3 is a carrier member since it is fixable to and removable from an mounting member 12. Therefore, as can be seen in FIG. 5, in the rear part, there are two locking protrusions 30 such that one of them is at the bottom and one of them is at the top. The end part of the one of the locking protrusions 30 is circular and the end part of the other one is cornered, this form indicates the position of the bearing bracket 3, in other words, describes which locking protrusion 30 is fixed to which of the housings 120 of the mounting member 12. A housing 320 the pipe retainer 4 will be fixed thereto and the channel 41 thereof will be placed thereto is formed on an extension 32 of the bearing bracket 3. As can be seen in FIG. 6, on the planar body 31, a locking hole 33 is embodied and one each reclining wall 310 is embodied in a vertical manner from the planar body and bent from the bottom side on both lateral parts such that there is one on the right and one on the left in the bottom part of the locking hole 33.

Figure 7:
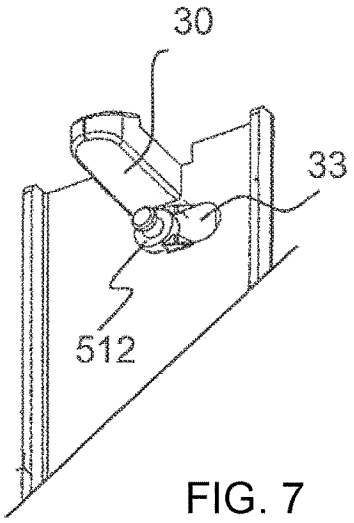
In FIG. 7, the perspective view of a locking hole of the bearing bracket and of a tab embodied on a locking hole, taken from FIG. 5, are given.

In FIG. 7, the rear view of a part of the bearing bracket 3 taken from FIG. 5 is given; it is the perspective view of a locking hole 33 and a tab 330 embodied on the locking hole 33. The locking hole 33 is for the reverse directional fixing extension 512 of the elastic fixing member 5. The protruding part 5121, held and drawn from the head part 5120, is passing through a wide part 331 of the locking hole 33 and it is pushed towards a narrow part 332. Thus, in the narrow part 332, a recessed part 5122 of the reverse directional fixing extension 512 is compressed and fixed. Fixation is facilitated by two tabs 330 holding the circular shaped protruding part 5121.

Figure 8:
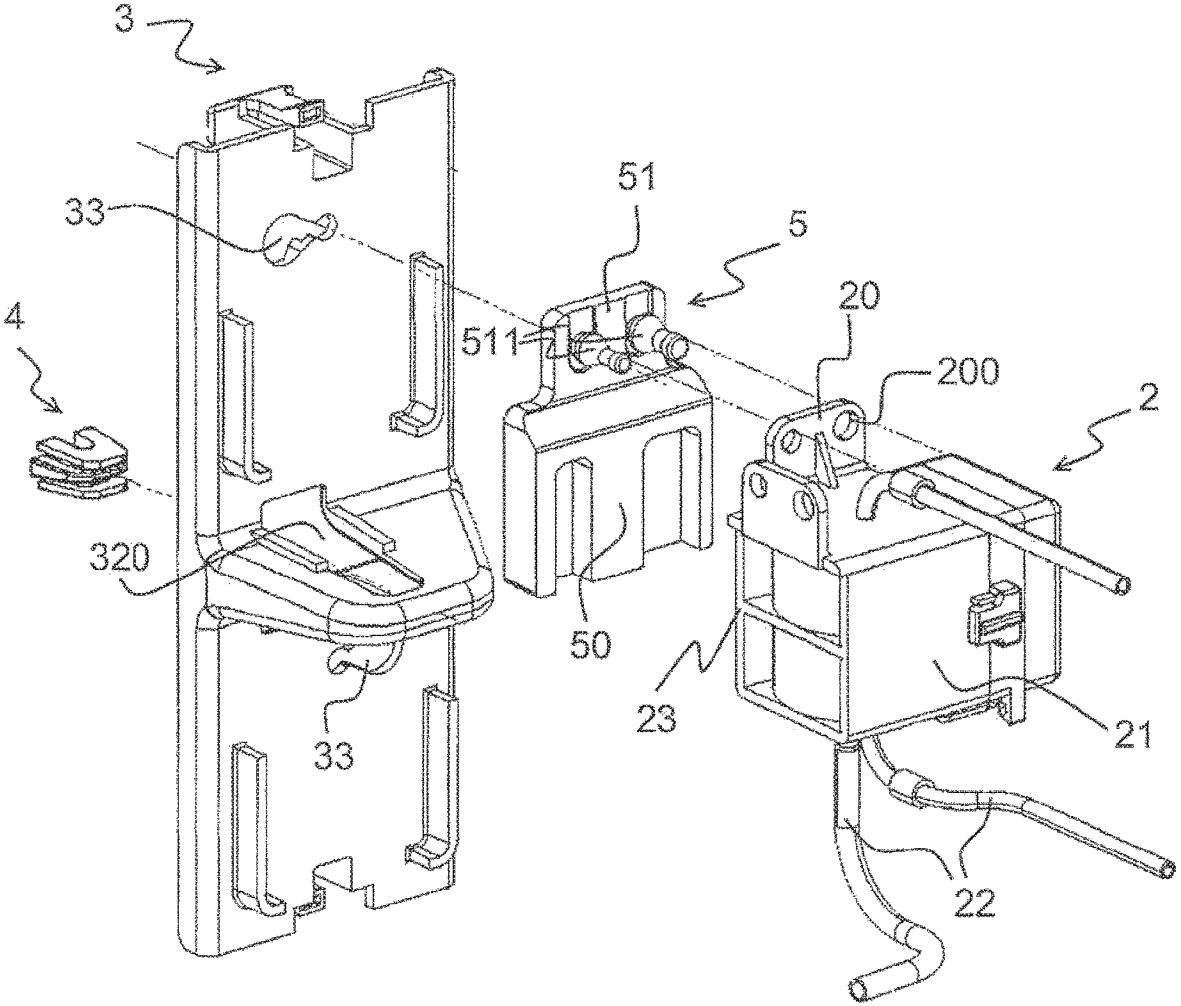
In FIG. 8, the common and dismantled view of a valve and of the subject matter elastic fixing member, the bearing bracket and the pipe retainer providing fixation of the valve are given.
Figure 10:
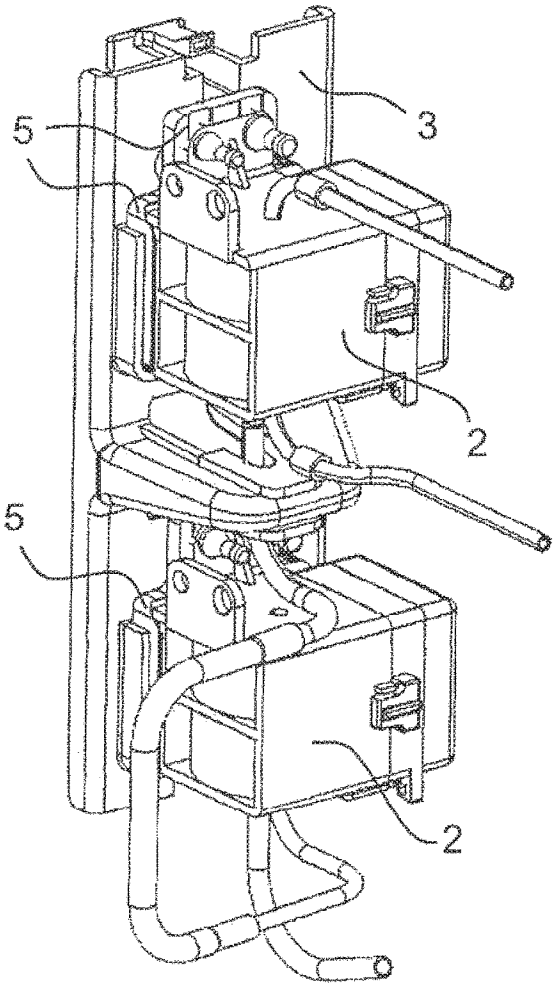
In FIG. 10, the common and mounted view of two valves and of the subject matter elastic fixing member, the bearing bracket and the pipe retainers providing fixation of the valves are given.
Figure 9:
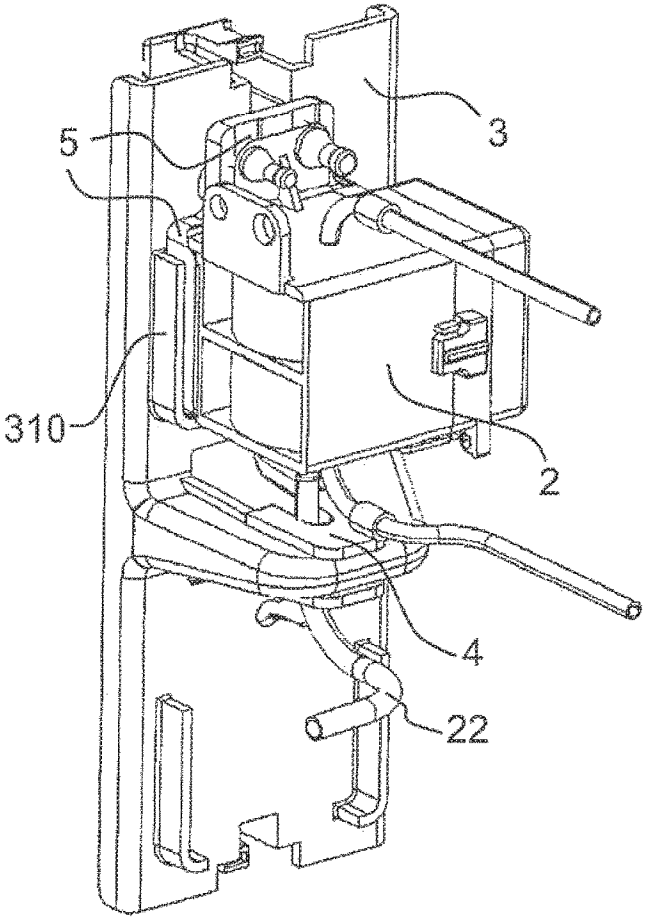
In FIG. 9, the common and mounted view of a valve and of the subject matter elastic fixing member, the bearing bracket and the pipe retainer providing fixation of the valve are given.

In FIG. 8, the common and dismantled view of a valve 2 and of the subject matter elastic fixing member 5, a bearing bracket 3 and pipe retainer 4 providing fixation of the valve 2 is given. In FIG. 9, the mounted view thereof is given. In FIG. 10, the common and mounted view of the two valves 2 on a bearing bracket 3 and of the subject matter elastic fixing member 5, the bearing bracket 3 and pipe retainer 4 providing fixation of the valves 2 is given. As can be seen in the given figure, two valves 2 can be mounted to one bearing bracket 3. One of the valves 2 is a solenoid valve 2 and the other one is a stop valve 2.

Figure 11:
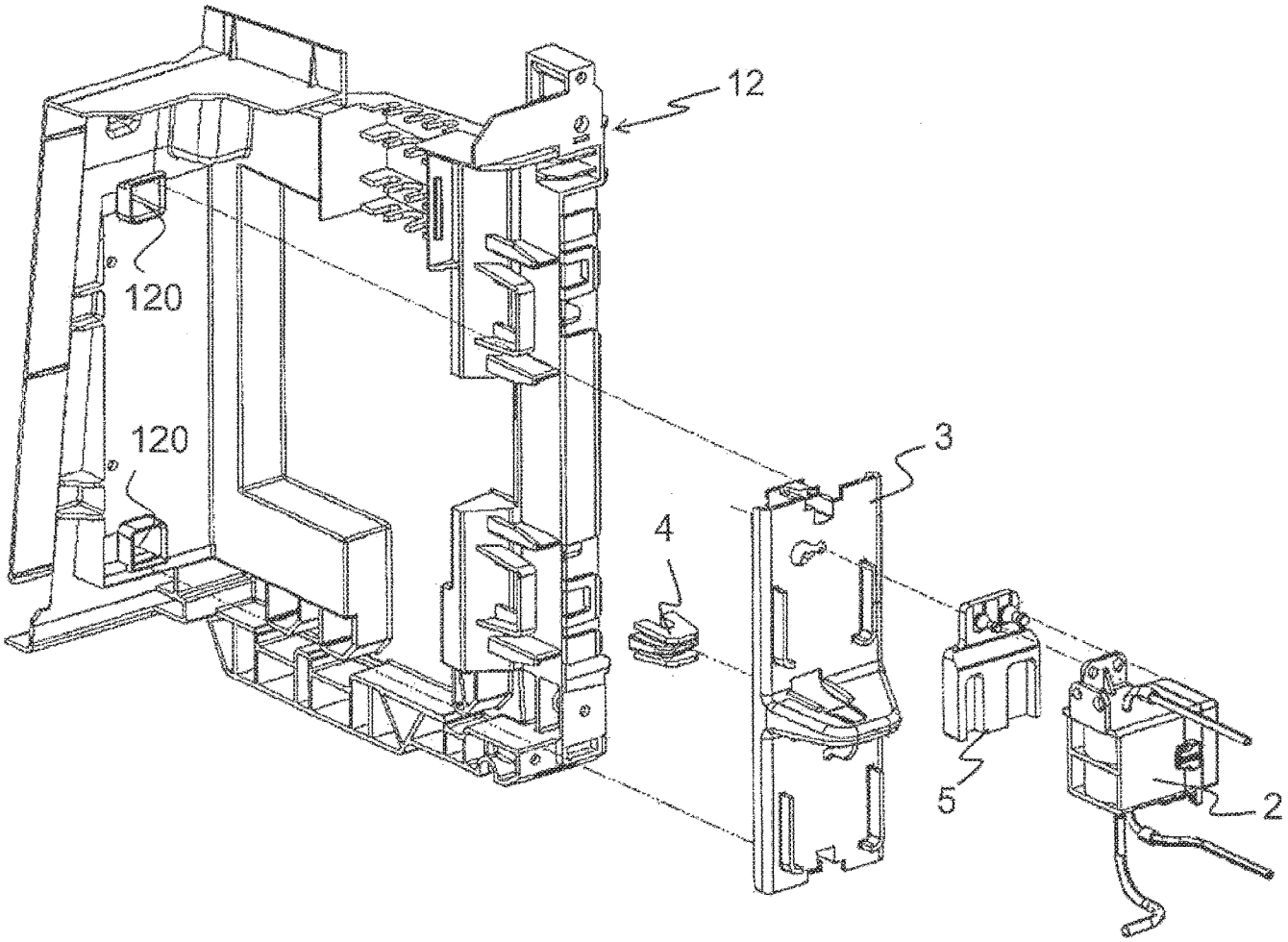
In FIG. 11, the common and dismantled view of an assembly member, a valve and the subject matter elastic fixing member providing fixation of the valve and of the bearing bracket and the pipe retainer are given.
Figure 12:
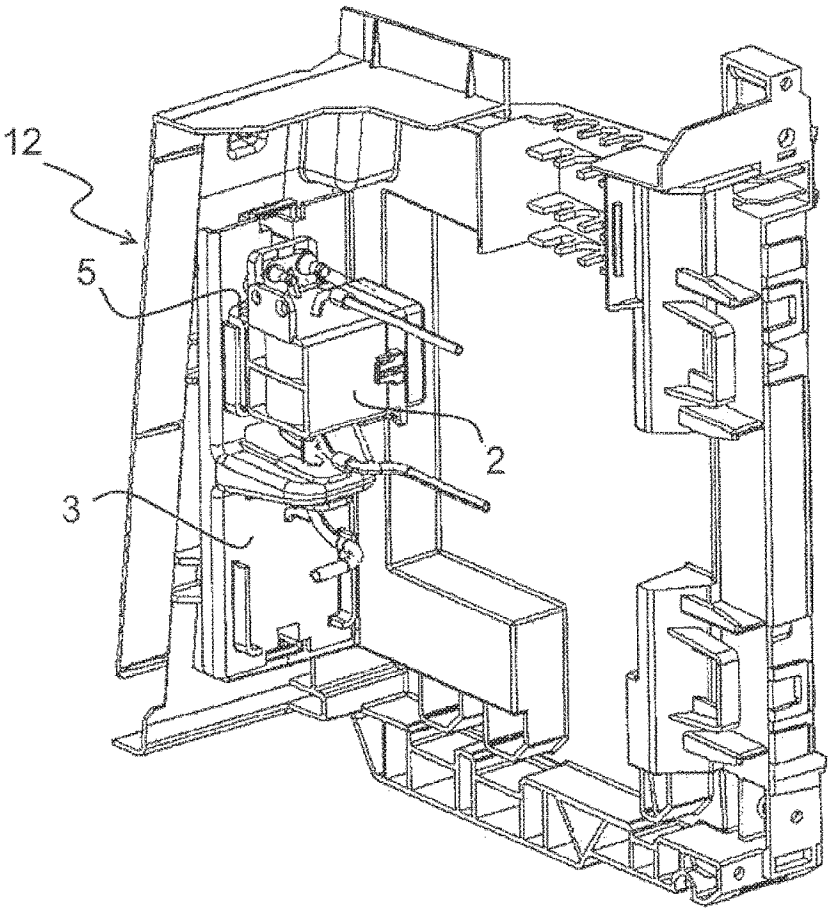
In FIG. 12, the common and mounted view of the bearing bracket, pipe retainer, an assembly member, a valve and the subject matter elastic fixing member providing fixation of the valve are given.
Figure 13:
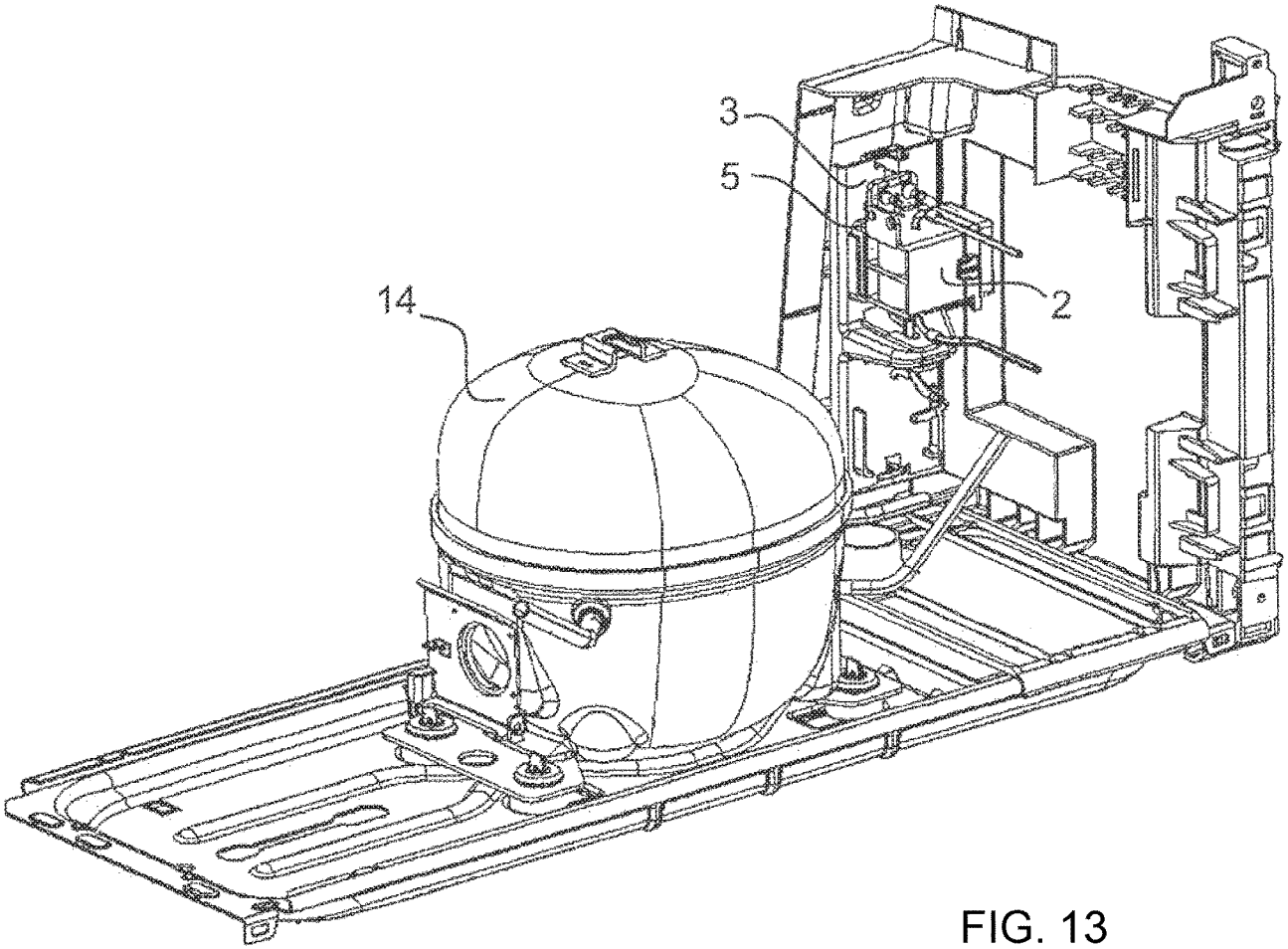
In FIG. 13, the integrated view of the members given in FIG. 12 is given together with a compressor.
Figure 14:
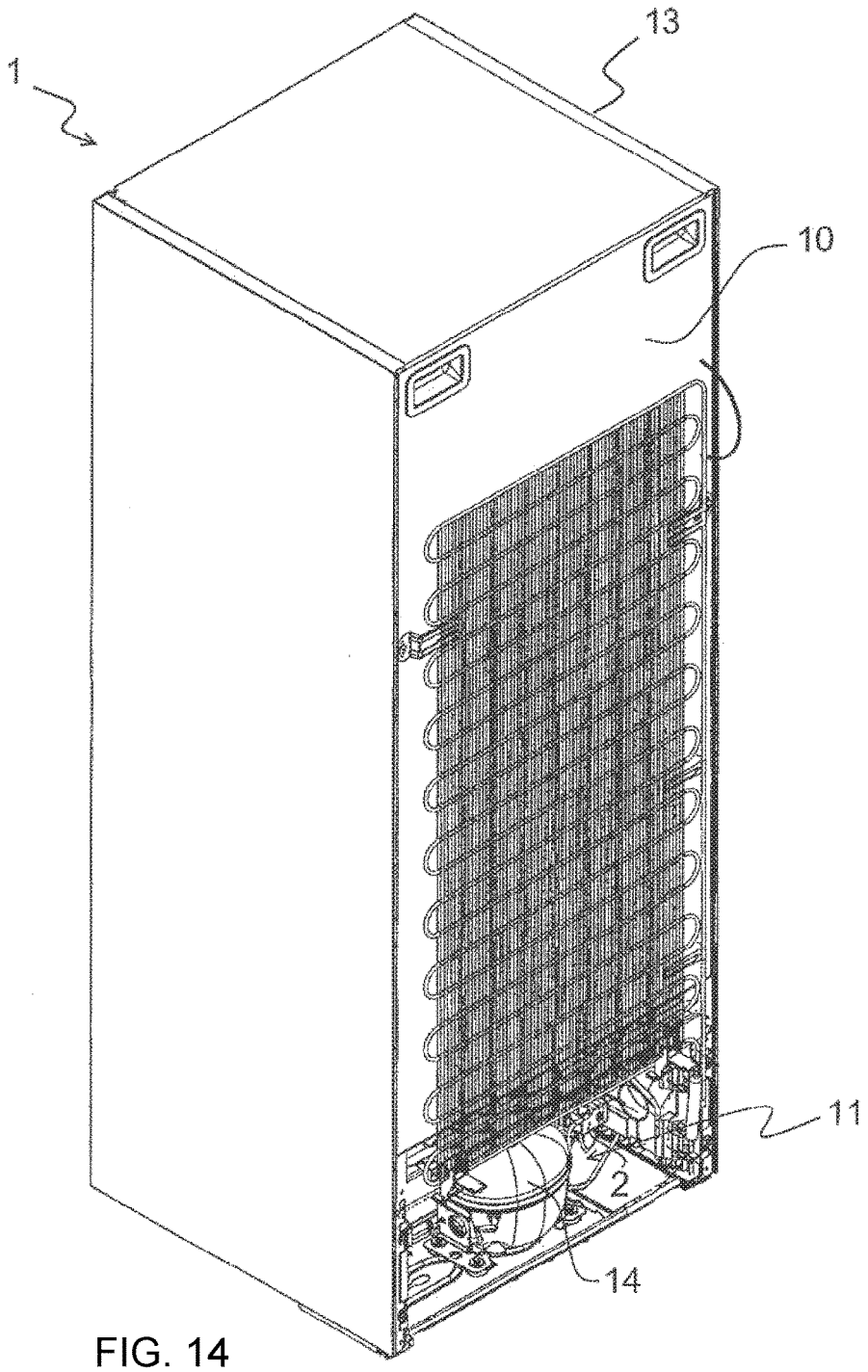
In FIG. 14, the positional view is given where the members, given in FIG. 13, are inside a compressor room formed on a rear wall of a cooling device.

In FIG. 11, the common and dismantled view of an mounting member 12, a valve 2 and the subject matter elastic fixing member 5 providing fixation of the valve 2 and of the bearing bracket 3 and the pipe retainer 4 is given. In FIG. 12, the mounted view thereof is given. In FIG. 13, the integrated view of the members given in FIG. 12 is given together with a compressor 14. In FIG. 14, the positional view is given where the members, given in FIG. 13, are inside a compressor room 11 formed on a rear wall 10 of a cooling device 1 body 13.

In more details, the operation of the present invention is as follows. The fixing extensions 511 of the elastic fixing member 5 are engaged to the holes 200 provided on the valve 2 extension 20, FIG. 11, 12. Since the elastic fixing member 5 is made of completely elastic material, the fixing extensions 511 are fixed to the holes 33 by being held from and drawn from the head parts 5110 thereof. Thus, a valve body 21 is reclined to the insulator section 50 of the elastic fixing member 5 through a lateral wall 23 thereof. On the other hand, the pipe retainer 4 is engaged to the housing 320 of the bearing bracket 3. A pipe 22 or pipes 22 of the valve 2 is/are passed through the opening 40 of the pipe retainer 4 and fixed. Afterwards, the elastic fixing member 5 integrated to the valve 2 is engaged to the locking hole 33 of the bearing bracket 3 through the reverse directional fixing extension 512 thereof. After the assembly, the valve 2, the elastic fixing member 5 and the pipe retainer 4 are assembled onto the bearing bracket 3. The bearing bracket 3 is assembled to both housings 120 of the mounting member 12 by fixing both locking protrusions 30 of the bearing bracket 3. Afterwards, the mounting member 12 is combined with the compressor 14 and disposed to the compressor room 11 of the cooling device 1.

One or more than one valve 2 can be mounted to the bearing bracket 3. Since there is/are elastic fixing members 5 between the valves 2 and the bearing bracket 3 or the mounting member 12, the elastic fixing member(s) 5 is/are absorbing the vibrations occurring during the operation of the valve 2. The elastic fixing member(s 5 provides the valve 2 to be mounted in a tight manner and on the other hand, absorbe(s) the vibrations. As a result of absorbing the vibrations, the noise spread to the environment by the valve 2 is decreased. The noise level is desired to be under 55 dB(A) in cooling devices 1. When valve 2 is mounted by utilizing elastic fixing member(s) 5, the measured sound level is 43-44 dB(A). Totally, a noise, which is at a 10 dB(A) lower level is obtained. Thus, since "dB(A)" is a logarithmic statement, noise is decreased 10 times.

The elastic fixing member 5 is made of a rubber and similar elastic material and formed in one piece. Thus, electrical insulation is obtained on the valve 2 at the same time. The bearing bracket 3 and the pipe retainer 4 are made of plastic material; however, it may be made of other different materials in alternative embodiments of the present invention. The mounting member 12 disposed to the compressor room 11 can be made of metal sheet or plastic material.

In an alternative embodiment of the present invention, the bearing bracket 3 can be extended or the number thereof can be increased depending on the number of valves 2 to be fixed. Moreover, the number of elastic fixing members 5 and of the pipe retainers 4 can be increased.

In an alternative embodiment of the present invention, an embodiment in the form of bearing bracket 3 can be formed on the mounting member 12. In other words, an extra bearing bracket 3 is not produced and it may be embodied on the mounting member 12 by providing form to the mounting member 12.

REFERENCE NUMBERS

| | | | |
|---|---|---|---|
| 1. | Cooling device | 4. | Pipe retainer |
| 10. | Rear wall | 40. | Opening |
| 11. | Compressor room | 41. | Channel |
| 12. | Mounting member | 42. | Protrusion |
| 120. | Housing | 5. | Elastic fixing member |

-continued

| REFERENCE NUMBERS | | | |
|---|---|---|---|
| 13. | Body | 50. | Insulator part |
| 14. | Compressor | 500. | Groove |
| 2. | Valve | 51. | Fixing part |
| 20. | Extension | 511. | Fixing extension |
| 200. | Hole | 5110. | Head part |
| 21. | Body | 5111. | Conic body part |
| 22. | Pipe | 5112. | Recessed part |
| 23. | Lateral wall | 512. | Reverse directional fixing extension |
| 3. | Bearing bracket | 5120. | Head part |
| 30. | Locking protrusion | 5121. | Protruding part |
| 31. | Planar body | 5122. | Recessed part |
| 310. | Reclining wall | | |
| 32. | Protrusion | | |
| 320. | Housing | | |
| 33. | Locking hole | | |
| 330. | Tab | | |
| 331. | Wide part | | |
| 332. | Narrow part | | |

The invention claimed is:

1. A cooling device, comprising:

a uniform elastic fixing member fixing a valve, which operates with a compressor, in a compressor room of a heat insulated body;

a bearing bracket fixing the valve to the compressor room, said bearing bracket having at least one locking hole having a wider part and a narrower part, said narrower part being laterally adjacent said wider part;

said uniform elastic fixing member having at least one reverse directional fixing extension for insertion into said at least one locking hole formed in said bearing bracket, said at least one reverse directional fixing extension having a head part, a protruding part corresponding to a form of said at least one locking hole by being shaped to pass through said wider part, and a recessed part which is compressed and fixed in said narrow part, and at least one fixing extension formed opposite of said reverse directional fixing extension and configured for insertion into at least one hole formed in the valve, and an insulator section for reclining the valve.

2. The cooling device according to claim 1, wherein said elastic fixing member includes a fixing section having said at least one fixing extension and said at least one reverse directional fixing extension, and said insulator section.

3. The cooling device according to claim 1, wherein said insulator section of said elastic fixing member is formed with at least one groove corresponding to a shape of a lateral wall of the valve.

4. The cooling device according to claim 2, wherein said fixing extension of said fixing section of said elastic fixing member comprises a head part, a conical body part corresponding to a hole of the valve, and a recessed part.

5. The cooling device according to claim 1, which comprises a valve holder group including said at least one bearing bracket, at least one pipe retainer, and said at least one elastic fixing member.

6. The cooling device according to claim 1, wherein said bearing bracket includes a planar body with a respective reclining wall at each edge of said planar body to fix the elastic fixing member from both sides.

7. The cooling device according to claim 1, wherein said locking hole of said bearing bracket is formed with a part in a circular shape and a narrow part continuing from said relatively wide part.

8. The cooling device according to claim 1, wherein said locking hole of said bearing bracket includes at least one tab provided to lock said rear directional fixing extension and formed on said locking hole.

9. The cooling device according to claim 1, wherein said bearing bracket comprises at least one locking protrusion formed on said bearing bracket and provided to mount said bearing bracket to at least one housing of a mounting member.

10. The cooling device according to claim 1, wherein said bearing bracket comprises:

a protrusion providing to fix a pipe of the valve, formed on said bearing bracket; and a housing formed on said protrusion and provided to insert a pipe retainer.

11. The cooling device according to claim 10, wherein said pipe retainer includes an opening configured to allow the pipe of the valve to pass through.

12. The cooling device according to claim 10, wherein said pipe retainer comprises at least one channel formed between two protrusions and provided to insert said pipe retainer.

* * * * *